US007926850B1

(12) United States Patent
Muncy et al.

(10) Patent No.: US 7,926,850 B1
(45) Date of Patent: Apr. 19, 2011

(54) METHOD FOR MANAGING MULTIPLE MEDICATIONS

(76) Inventors: Lisa A. Muncy, St. Louis, MO (US); Charles W. Muncy, St. Louis, MO (US); Gary A. Muncy, Chesterfield, MO (US)

( * ) Notice: Subject to any disclaimer, the term of this patent is extended or adjusted under 35 U.S.C. 154(b) by 529 days.

(21) Appl. No.: 11/687,972

(22) Filed: Mar. 19, 2007

(51) Int. Cl.
*B42D 15/00* (2006.01)

(52) U.S. Cl. ..... 283/70; 283/900; 283/115; 283/67; 206/570; 40/310; 40/776

(58) Field of Classification Search ..... 283/55, 283/63.1, 64, 66.1, 67, 70, 74, 75, 81, 115, 283/117, 900; 206/577, 570, 534, 528, 232; 40/310, 402, 776
See application file for complete search history.

(56) References Cited

U.S. PATENT DOCUMENTS

| | | | | |
|---|---|---|---|---|
| 3,826,222 | A | 7/1974 | Romick | |
| 4,473,156 | A * | 9/1984 | Martin | 206/534 |
| 4,815,767 | A * | 3/1989 | Lambert | 283/67 |
| 5,102,169 | A * | 4/1992 | Mayfield | 283/115 |
| 5,261,702 | A | 11/1993 | Mayfield | |
| 5,393,100 | A | 2/1995 | Coe | |
| 5,431,450 | A | 7/1995 | Coleman | |
| 5,601,314 | A | 2/1997 | Burns et al. | |
| 5,642,906 | A | 7/1997 | Foote et al. | |
| 5,752,723 | A | 5/1998 | Robertson | |
| 6,135,507 | A * | 10/2000 | Hamby et al. | 283/81 |
| 6,227,371 | B1 * | 5/2001 | Song | 206/534 |
| 6,294,999 | B1 | 9/2001 | Yarin et al. | |
| 6,685,227 | B2 | 2/2004 | Merry et al. | |
| 6,769,545 | B1 | 8/2004 | Mallams | |
| 6,860,390 | B2 | 3/2005 | Bowman | |
| 6,951,353 | B2 | 10/2005 | Kozlowski et al. | |
| 6,994,249 | B2 | 2/2006 | Peterka et al. | |
| 2004/0075272 | A1 | 4/2004 | Kaufman | |
| 2004/0188998 | A1 | 9/2004 | Henthorn | |
| 2005/0092647 | A1 | 5/2005 | McBain | |
| 2007/0043530 | A1 * | 2/2007 | O'Rourke | 702/177 |

* cited by examiner

*Primary Examiner* — Dana Ross
*Assistant Examiner* — Pradeep C Battula
(74) *Attorney, Agent, or Firm* — Grace J. Fishel

(57) ABSTRACT

A comprehensive organizational system for managing medical records for an individual patient and a method for managing the dispensation of multiple medications. The method includes a set of symbols indicating the time of day the medication should be administered in accordance with the prescription instructions and a storage system for duplicate prescription labels corresponding to the prescription labels on the prescription containers. The dosage schedule and amount are translated into the symbols which are applied to each duplicate prescription label. Medications are dispensed to the patient in accordance with the symbols applied to the duplicate prescription labels.

10 Claims, 5 Drawing Sheets

METHOD FOR MANAGING MULTIPLE MEDICATIONS

BACKGROUND OF THE INVENTION

1. Field of the Invention

The present invention relates to a comprehensive organizational system for managing medical records for individual use and to a method for managing multiple medications which may be an integral part of the comprehensive system.

2. Brief Description of the Prior Art

Failure to take medications according to prescription instructions is a common reason for a bad medical outcome. Sometimes patient non-compliance results from a misunderstanding of the prescription instructions. For example, the prescription label may say "Take one capsule every six hours" and the patient assumes, incorrectly, that this does not include the hours during sleep.

More often, failure to take medications according to the prescription instructions results from mistakes. With elderly patients having one or more chronic illnesses (such as diabetes and congestive heart failure), the patient may have multiple medications, each medication having its own timetable and dosage, and each with accompanying instructions and warnings. The wrong medication may be given at the wrong time, or an improper dosage may be given or the medication may be omitted completely because the prescription container has been mislaid. Further, particularly among elderly patients, the timing and dosage of medications may be subject to frequent change, even from day to day.

Commonly, it is a family member, friend or other caregiver who has the responsibility of organizing and dispensing medications on a daily basis for elderly or chronically ill patients. The responsibility is stressful and the possibility for mistake is compounded when there is more than one caregiver. Another problem occurs when an ambulance is called to the home of a chronically ill person. If the caregiver is not present, often no person in the home knows or remembers the medication regime. Pill bottles may be gathered up and taken along with the patient to the hospital. It is difficult in an emergency situation to treat the patient when the treating physician has no idea what medication has been taken and what medication has not.

The need to manage the dispensation of multiple medications has been recognized. Various devices have been provided to make it easier to organize multiple medications. One common device is in the form of a container having different compartments arranged in columns, one for each day of the week, each column having three or four rows. The device, however, does not prevent giving the wrong medication at the wrong time, or giving an improper dosage or forgetting to give a medication as the caregiver must interpret the instructions on the prescription label each time the device is filled. In addition, the system provides no information in an emergency situation as to what medication has been taken and what medication has not when the pill bottles in the home are gathered up and taken along with the patient.

U.S. Pat. No. 5,261,702 proposes a system that includes a wall chart with the names of the medications to be taken by the patient along with times of day that the medications are to be taken. A symbol having a distinctive shape such as a circle, square, triangle and the like is placed by the name of the medication on the chart and on the prescription container. The chart may be used in combination with a pill organizer as described above, but the system does not prevent giving the medication at the wrong time or giving an improper dosage as the caregiver must interpret the instructions on the chart each time the device is filled. The chart merely associates the names of the medications with the prescription containers by symbols, rather than by pharmaceutical names. When a drug is suspended, the system described in the '702 patent calls for drawing a line through the entry on the chart. The wall chart is likely to be hung near the place that the caregiver fills the patient's medication tray and in an emergency situation may not be taken along with the patient, leaving the treating physician in the dark as to what medications the patient is taking.

BRIEF SUMMARY OF THE INVENTION

In view of the above, it is an object of the present invention to provide a comprehensive organizational system for personal use in managing medical records. It is another object to provide a method for managing multiple medications. Other objects and features of the invention will be in part apparent and in part pointed out hereinafter.

In accordance with the invention, a comprehensive organizational system for managing medical records of an individual is provided. The system may be in the form of a binder containing a number of sections, a first one of which may contain vital medical information such as the patient's name, emergency contacts, insurance information, surgeries, current physicians, hospital preference, etc. Another section of the binder contains a storage system for duplicate prescription labels corresponding to the prescription labels on the prescription containers of drugs actively being taken by the patient. Another section of the binder may contain a storage system for the duplicate prescription labels of drugs not currently being taken by the patient.

A set of symbols indicating the time of day a medication should be taken is provided. The symbols may be in the form of stickers which are distinguishable by geometric shape or by color. The prescription instructions which include dosage schedule and amount are translated by a caregiver into the symbols, the selected symbols indicating the dosage schedule and number of said selected symbols indicating the amount. Stickers in accordance with the translation are applied to the duplicate prescription labels of the drugs currently being taken by the patient. Another set of stickers may be applied to the prescription labels on the containers of the drugs actively being taken.

A caregiver may then dispense the medications to a patient in accordance with the stickers applied to the duplicate prescription labels or to the prescription labels on the containers. A pill organizer with a plurality of compartments arranged in columns, one for each day of the week, and rows, one for morning, noon and evening may be provided. To facilitate filling the pill organizer, each row of compartments may be marked with the symbols indicating the time of day the medications placed in the compartment are to be taken.

The invention summarized above comprises the system and method hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
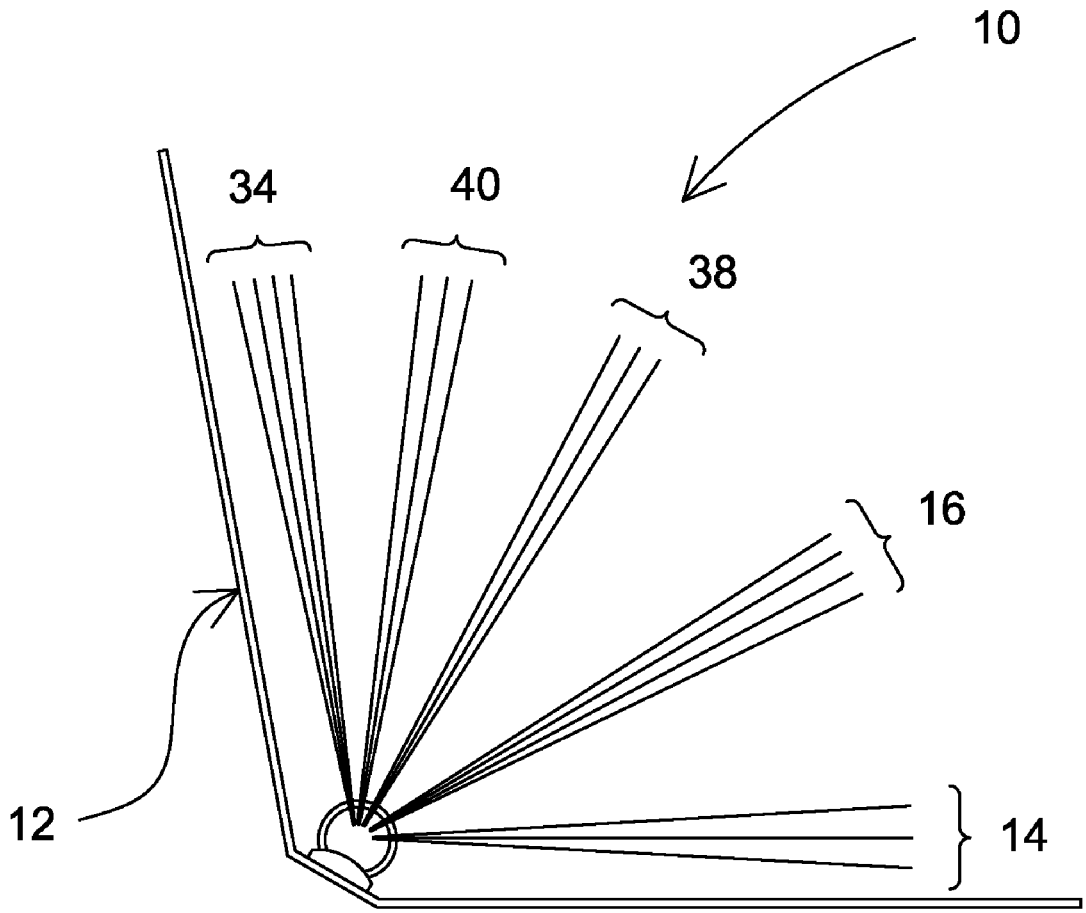
FIG. 1 is a top view of a binder containing a comprehensive organizational system for personal use in managing medical records in accordance with the present invention.

Referring to the drawings more particularly by reference character, reference numeral 10 refers to a comprehensive organizational system for managing medical records, a portion of which system is part of a method for managing multiple medications in accordance with the present invention.

As illustrated in FIG. 1, system 10 may take the form of a record book which may be conveniently housed in a three-ring binder 12. It will be understood, however, that system 10 may be a bound book, a set of file folders or the like. Three-ring binder 12 is preferred because is portable, binds the records together, and can be easily taken along with the patient on vacation, to the doctor or, in an emergency situation, to the hospital. Three-ring binder 12 also allows for the addition or replacement of pages.

The pages of system 10 are organized into sections for storing patient records. For example, information about the patient may be entered in first section 14. This information may include the patient's name, address and telephone numbers, emergency contact names and numbers and insurance information. Other pages in first section 14 may include a medical history including a list of surgeries with dates, hospital, surgeon's name and reason for surgery. If the patient has implants, a description of each implant together with serial number, date of implant, etc. may also be included along with information concerning allergies. A listing of the patient's preferred hospital, address and main telephone number may be provided.

First section 14 may also include a listing of the patient's primary physician and any specialists that he or she is currently seeing together with pages with slots for the doctors' business cards. Calendar pages may be included for noting medical appointments along with pages with slots for medical appointment cards. If the patient has a living will or a medical power of attorney, a copy of these documents may also be provided.

A second section 16 of system 10 forms part of the subject method for managing multiple medications. While first section 14 is part of comprehensive organizational system 10, it is not necessary to practice the method for managing multiple medications.

Figure 2:
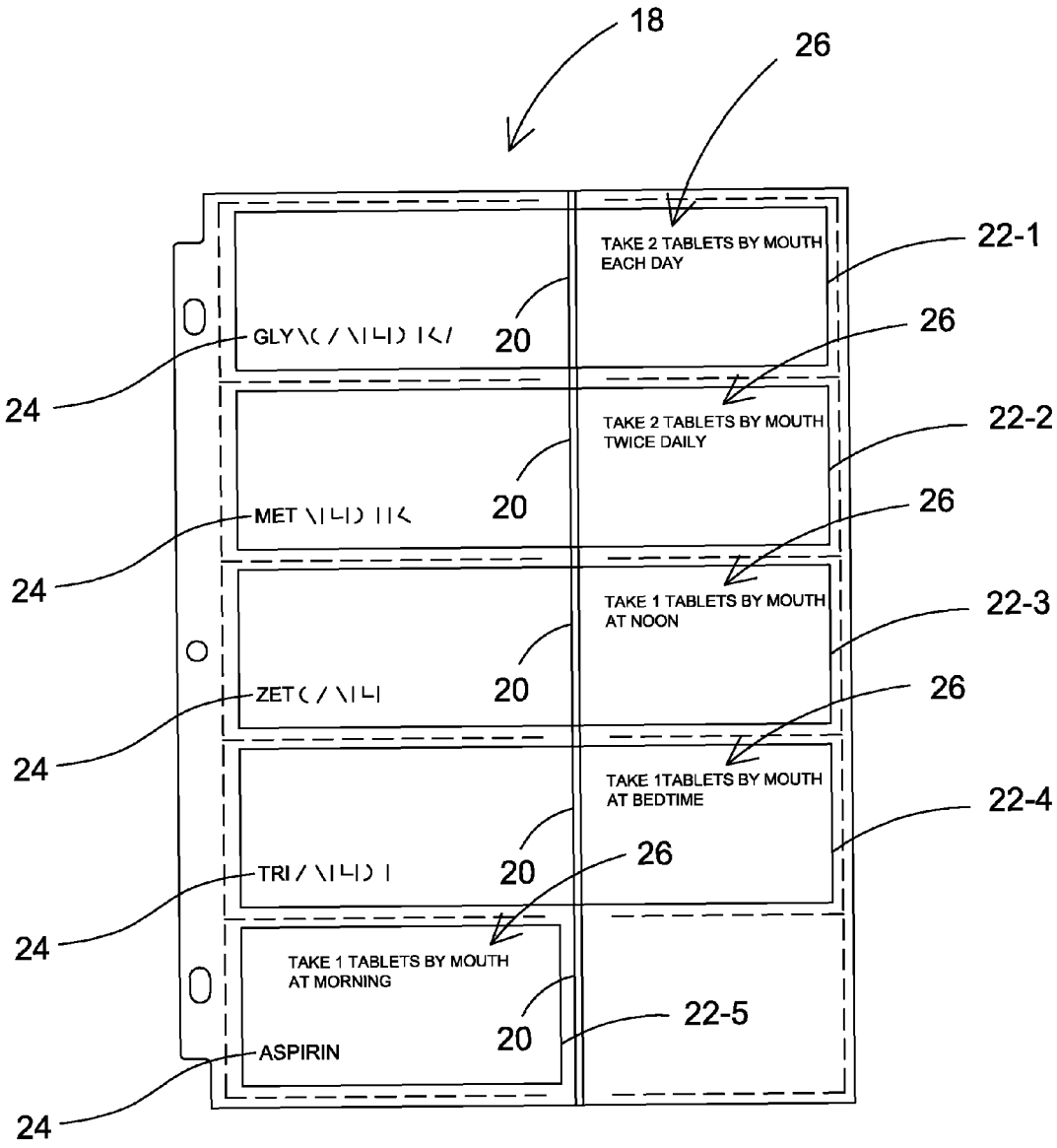
FIG. 2 is a plan view of a page from a second section of the comprehensive system listing current medications for a patient.

Second section 16 like first section 14 may take the form of several pages. As shown in FIG. 2, each page 18 of second section 16 has one or more slots 20 or the like for receiving a duplicate prescription label 22 as provided by pharmacies. The information on duplicate prescription label 22 includes the name of the medication 24 and prescription instructions 26 which include the dosing schedule and amount of medication to be administered. Other pertinent information may include the patient's name, prescription number and the prescribing doctor's name.

A page 18 for each medication may be provided in second section 16 or as shown in FIG. 2, a plurality of duplicate prescription labels 22 may be shingled on each page. What is important is that second section 16 include a listing of each medication that the patient is currently taking. Nonprescription items such as aspirin, vitamin-mineral supplements and herbal remedies, should also be included in second section 16 including the dosing schedule and amount.

After all of the patient's active medications have been listed in second section 16 as described above, the next step in the system for managing multiple medications is to translate the dosing schedule and amount into symbols 30 which are attached to each duplicate prescription label 22 and, preferably, also attached to a corresponding prescription container 32. For this purpose different symbols 30 may be used to indicate the dosing schedule and to indicate the amount.

Figure 4:
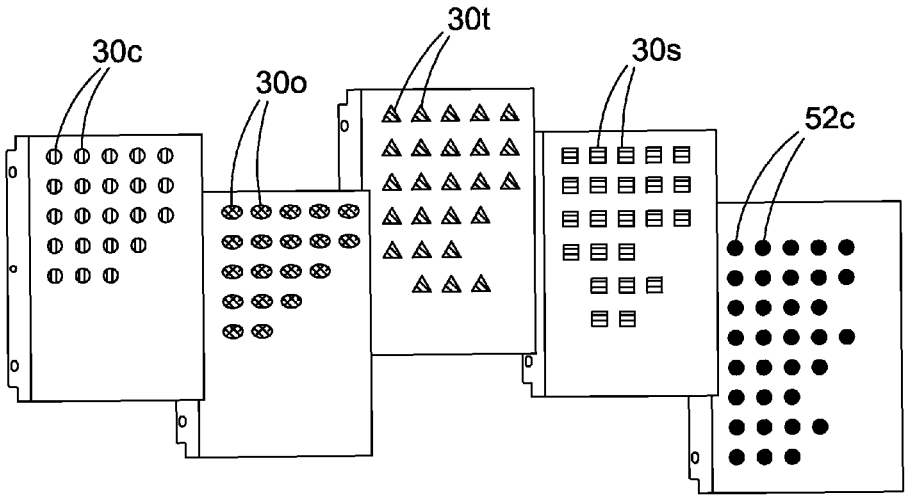
FIG. 4 is a plan view of a plurality of pages with symbols used to encode the dosing schedule and amount on the duplicate prescription labels of the active prescriptions and on the corresponding prescription containers.

A plurality of pages with symbols 30 for use as described above may be provided and stored in a fifth section 34 of system 10 along with other supplies such as extra pages for the other sections. Symbols 30 must be distinguishable by shape or color or by both shape and color to accommodate those who are color blind. As shown in FIG. 4, symbols 30 may take the form of various geometric shapes such as circles 30-C, ovals 30-0, triangles 30-T and squares 30-S and may be provided as removable stickers. Other symbols 30 may be used such as a cross, a pentagon, a parallelogram, a five point star, a crescent and so forth with the only limitation being that the stickers should be easily distinguishable by shape. When colors are used, symbols 30 must be easily distinguishable by color. For example, as shown in FIG. 4, circles 30-C are red, ovals 30-0 are orange, triangles 30-T are green and squares 30-S are blue. A second set of circles 30-C may be black for use as described hereinafter. It will be understood that the selection of the colors and the association of particular colors with particular shapes is arbitrary. Circles 30-C may be blue, crescents red, etc.

For use in managing multiple medications in accordance with the present invention, while the shapes and colors of symbols 30 are arbitrary, a meaning must be assigned. Each shape and/or color must be assigned to a time of the day. For example, as illustrated in the drawings a red circle 30-C designates morning, an orange oval 30-0 denotes noon, a green triangle 30-T means evening and a blue square 30-S marks bedtime.

Besides the geometric and color symbols 30 mentioned above, other symbols may be provided such as a drawing of a spoon, an inhaler, a syringe, a tube and such other forms as various medications are found. If a capsule or tablet is to be split, symbols 30 as described above may be cut in half or provided with a line through the middle indicating that the medication is to be split.

Figure 3:
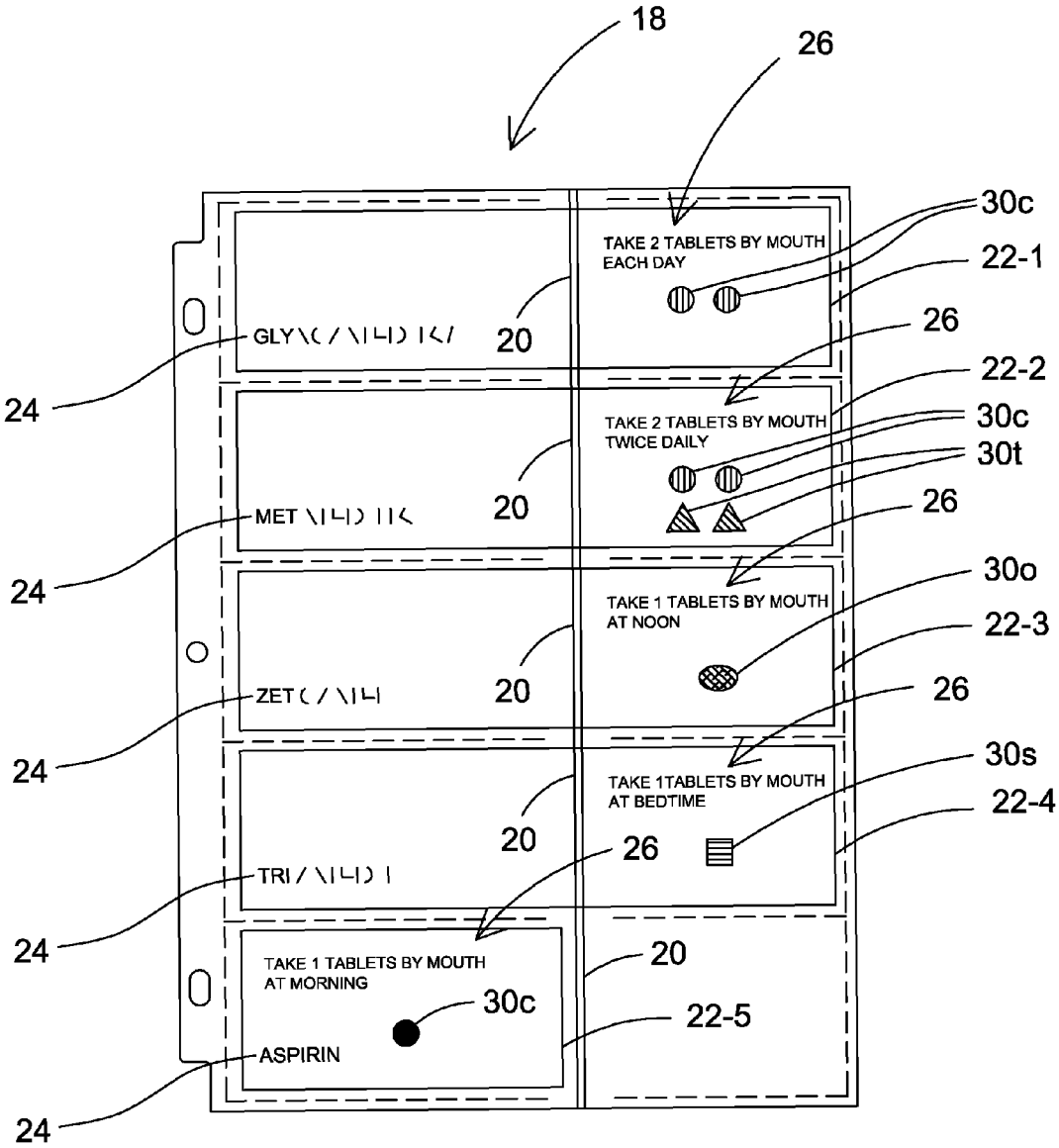
FIG. 3 is a plan view of the page in FIG. 2 after the dosing schedule and amount of medication have been translated into symbols.

As disclosed above, after the patient's current medications have been listed in second section 16, the prescription instructions 26 are translated into symbols 30, the meanings of which have been assigned. For example, as shown in FIG. 3, first duplicate prescription label 22-1 is for GLY . . . with prescription instruction 26: "Take 2 tablets by mouth each day." If the caregiver has any questions regarding the prescription, i.e., should the tablets be taken at a particular time of day, etc., the caregiver should ask the prescribing doctor or consult with a pharmacist at the pharmacy who filled the prescription. By asking questions when the prescription is being translated into symbols, failure to take the medication according to prescription directions may be avoided.

Figure 5:
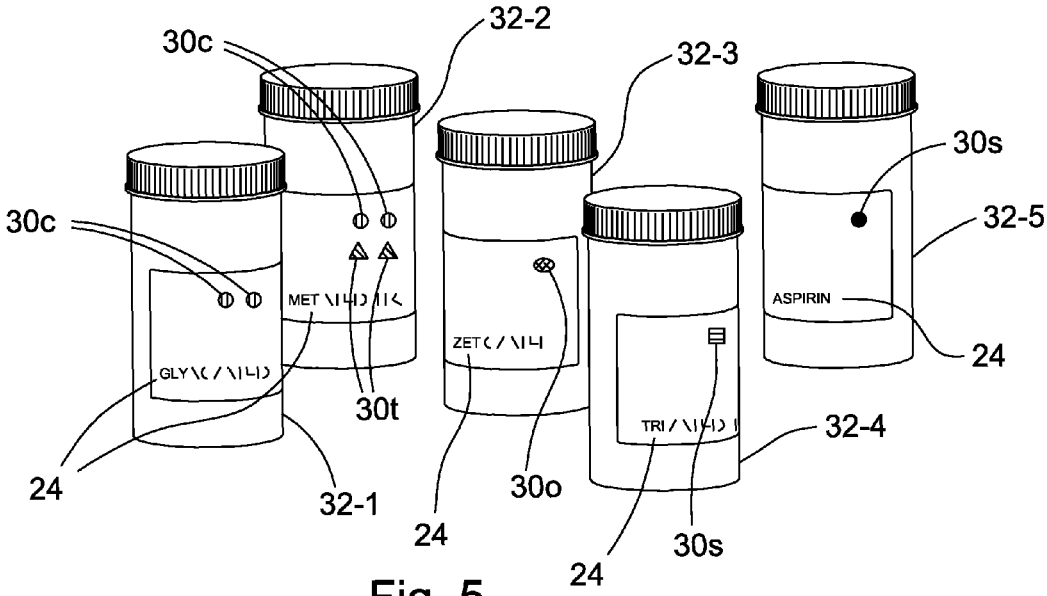
FIG. 5 is a perspective view of the active prescription containers corresponding to the duplicate prescription labels in FIGS. 2 and 3; and, FIG. 6 is perspective view of the duplicate prescription labels and the corresponding prescription containers encoded with symbols in use in distributing medications into a pill organizer.
Figure 6:
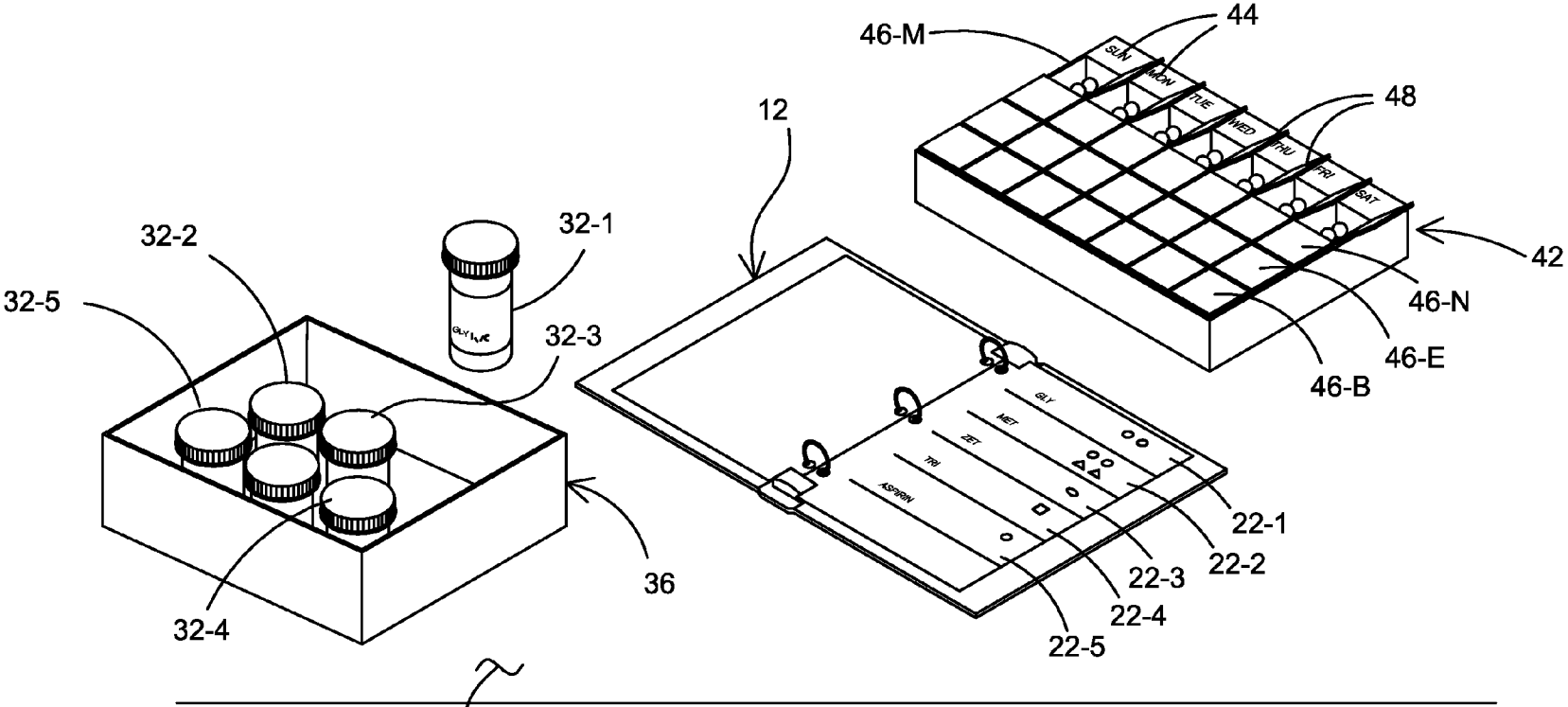

With continuing reference to prescription label 22-1 in FIG. 3, if it determined that GLY . . . may be taken in the morning, perhaps after consultation with a pharmacist, the label is coded with two red circles 30-C, the red circles indicating that the medication is to be taken in the morning, two red circles indicating that two units of the medication are to be taken. The prescription container 32-1 as shown in FIG. 5 which corresponds to duplicate prescription label 22-1 may be correspondingly marked with two red circles 30-C also. The caregiver then continues coding duplicate prescription labels 22-2 through 22-5 with symbols 30 as shown in FIG. 3 and marking prescription containers 32-2 through 32-5 as shown in FIG. 5. Active prescription containers 32-1 through 32-5 are then transferred to a holding tray 36 as shown in FIG. 6 or to a bag. Tray 36 or bag should contain only those prescriptions listed in second section 16 and no others.

System 10, in addition to first, second and fifth sections 14, 16 and 34, respectively, may include a third section 38 to store duplicate prescription labels 22 of discontinued prescriptions and a fourth section 40 to store the accompanying instructions and warnings which may be attached to duplicate prescription labels 22. In third section 38, pages with slots 20 like those for active prescriptions in second section 16 may be provided. When an inactive prescription is transferred to third section 38, the date of discontinuation and reason for discontinuation may be noted on duplicate prescription label 22. At the time the discontinued duplicate label 22 is removed from second section 16, the corresponding prescription container 32 should be removed from tray 36 or bag in which only the active prescriptions are stored. The discontinued medication may be stored is another tray or bag, available to be moved back into the active prescription category if the medication is re-prescribed. Symbols 30 applied to discontinued duplicate label 22 and the corresponding prescription container 32 may be removed as the dosing schedule and amount may be changed if the patient is instructed to start taking the drug again.

Turning now to FIG. 6, the system for managing multiple medications in accordance with the present invention may be used by a caregiver to distribute a patient's medications in a pill organizer 42 as shown in FIG. 6. Pill organizer 42 may be for a single day in which case there is a single column 44 with a number of rows 46 representing times of the day. As shown in FIG. 6, pill organizer 42 is for a week and has seven columns 44, each of which has four rows 46 to divide each day into four time periods—namely, morning 46-M, noon 46-N, evening 46-E and bedtime 46-B. It will be understood that pill organizer 42 may be provided with fewer than four or more than four rows depending on how the day is to be divided (e.g., into 6 or 8 hour intervals). Each compartment is closed with a door 48 hinged along one side.

For use with the subject system for managing multiple medications, it is preferred that doors 48 be marked with the same symbols 30 used to designate the time of day on duplicate prescription labels 22 and prescription containers 32. Hence on doors 48 a red circle 30-C indicates morning, an orange oval 30-0 means noon, a green triangle 30-T denotes evening and a blue square 30-S marks bedtime. In FIG. 6, the geometric symbols and colors are displayed as follows: Doors 48 in first row 46-M are be marked with red and with a circle 30-C, second row 46-N with orange oval 30-O, third row 46-E with green triangle 30-T, and fourth row 46-B with blue square 30-S.

When the caregiver is ready to service pill organizer 42, he or she may open three-ring binder 12 to second section 16 where the patient's active prescriptions are listed. Starting with duplicate prescription label 22-1, for example as shown in FIG. 3, the caregiver will see that the symbols 30 for the dosing schedule are red and will open all of the red doors 48 in row 46-M. He or she will then remove container 32-1 from tray 36 or the storage bag in which the active medications are kept and observe that on both the prescription label 22-1 and container 32-1 that the dosing amount is two tablets (symbolized by two circles 30-C) and place two tablets in each of the open compartments. After completing this step, doors 48 in row 46-M are closed and container 32-1 may be placed on a counter 50 beside tray 36.

Working down the page shown in FIG. 3, the caregiver will see that on duplicate prescription label 22-2 the dosing schedule has been translated into two red circles 30-C and two green triangles 30-T, and will open all of red doors 48 in row 46-M and all of green doors 48 in row 46-E. He or she will then remove containers 32-2 from tray 36 and place two tablets (symbolized by two circles 30-C) in each of the open compartments in red row 46-M and two tablets (symbolized by two triangles 30-T) in each of the open compartments in green row 46-E. All doors 48 in row 46-M and row 46-E are then closed and container 32-2 may be placed on counter 50 along with the container 32-1. The caregiver will then continue through the list of active medications in second section 16 until all of containers 32-1 through 32-5 have been removed from tray 36, whereupon the distribution of medications into pill organizer 42 is complete. All of the active medications may then be returned to tray 36. A separate notebook (not shown) or a page in binder 12 may be provided for the purpose of listing prescriptions which are noted to be in need of being refilled in the course of distributing the medications into pill organizer 42.

Pill organizer 42 may take forms other than that shown in FIG. 6. For example, pill organizer 42 may be a bubble pack tray which may be clipped in binder 12. A section of bubble pack tray may be broken away from the balance of the tray, as for example, for use during a day. The compartments in bubble pack tray may be either pre-marked with symbols 30 or customized with symbols 30 to the needs of the user, for example by applying stickers to the compartments.

If one of duplicate prescription labels 22 calls for a drug which is not a capsule or tablet, as for example, in the form of an inhaler, a liquid taken by teaspoons, an ointment in a tube, an injection, etc., a black circle 52-C such as shown in FIG. 4 may be applied to duplicate prescription label 22 indicating that prescription instructions 26 are special. Alternatively, duplicate prescription label 22 may be marked with a symbol illustrating the dosage method, such as a drawing of an inhaler, teaspoon, tube, needle, etc. When pill organizer 42 is filled as described above, a token representing the dosage form may be placed in the appropriate compartments as a reminder. The token may be sized or shaped such that the patient is not likely to accidentally swallow it and may also be made of a material such that it is not harmful if such an accident occurs.

If prescription instructions 26 are changed for one of the drugs in second section 16, the caregiver may note the date of the change on duplicate prescription label 22 and re-code it with symbols 30. The label on corresponding prescription container 32 is re-coded and whatever additions or subtractions of medications to comply with the new prescription instructions are made in pill organizer 42. Thus it is seen that the present method for managing multiple medications readily accommodates changes in the timing and dosage of medications such as frequently occur with elderly patients.

The present method for managing multiple medications is inexpensive because it makes use of preexisting materials. For example, duplicate prescription labels 22 are provided by a pharmacy when a prescription is filled. Three-ring binders 12 and colored stickers for use as symbols 30 are readily available from a stationer. Tray 36 (or a bag) and pill organizer 42 are also off-the-shelf items. Doors 48 may be simply marked with the same sticker symbols 30 that are used on active duplicate prescription labels 22 in second section 16 and on active prescription containers 32.

If there is more than one caregiver, the system for managing multiple medications reduces the chance for error as the second caregiver need not translate the prescription. The dosing schedule and the amounts are readily apparent. All that need be done is to match duplicate prescription labels 22 with prescription containers 32 in tray 36 and, following symbols 30, fill pill organizer 42.

In the event an ambulance is called to the home of the patient and the caregiver is not present, binder 12 and pill organizer 42 may be taken along to the hospital with the patient. By examining the list of active prescriptions in second section 16 and the tablets that remain in pill organizer 42, a treating physician will know exactly what medications have been taken and be in better position to treat the patient in an emergency situation.

In view of the above, it will be seen that the several objects of the invention are achieved and other advantageous results attained. As various changes could be made in the above system and method without departing from the scope of the invention, it is intended that all matter contained in the above description or shown in the accompanying drawings shall be interpreted as illustrative and not in a limiting sense.

What is claimed is:

1. A method under the control of a patient or a caretaker for managing multiple medications for an individual patient prescribed by one or more physicians in different practices, each medication in a prescription container with a prescription label, said method comprising the steps of:

providing the patient or the caretaker with a storage system with pockets for removably storing and visually displaying duplicate prescription labels only for prescriptions currently being taken by the patient corresponding to the prescription labels on the prescription containers, said duplicate prescription labels provided by a pharmacy to the patient or the caregiver, said duplicate prescription labels providing prescription instructions as to the dosage schedule and amount; and the patient or the caretaker inserting the duplicate prescription labels for the prescriptions currently being taken by the patient into the pockets and removing duplicate prescription labels from the pockets of any prescriptions not currently being taken by the patient;

providing the patient or the caretaker with distinctive symbols to indicate different times;

the patient or the caretaker translating the prescription instructions of each duplicate prescription label in the pockets of the storage system into the symbols, the selected symbols for each prescription indicating the dosage schedule and by the number of said selected symbols indicating the amount;

the patient or the caretaker applying the selected symbols to each duplicate prescription label in the pockets of the storage system and to each prescription container; and, the patient or the caretaker dispensing said medications to a patient in accordance with the symbols applied to the duplicate prescription labels or to the prescription containers.

2. The method of claim 1 further comprising the steps of:

providing a pill organizer with a plurality of compartments arranged in columns and rows;

applying the symbols to indicate time to the rows; and, dispensing said medications into the pill organizer in accordance with the symbols applied to the duplicate prescription labels or to the prescription containers.

3. The method of claim 2 wherein the different times are time divisions appropriate to the prescription instructions.

4. The method of claim 3 wherein the symbols are distinguishable by geometric shape.

5. The method of claim 3 wherein the symbols are distinguishable by color.

6. The method of claim 3 wherein the symbols are distinguishable by geometric shape and color.

7. A method under the control of a patient or a caretaker for managing multiple medications for an individual patient prescribed by one or more different physicians in different practices, each medication in a prescription container with a prescription label, said method comprising the steps of: providing the patient or the caretaker with a first storage system with pockets for removably storing and visually displaying duplicate prescription labels corresponding to the prescription labels on the prescription containers of drugs being actively taken by a patient, said duplicate prescription labels provided by a pharmacy to the patient or the caregiver, said duplicate prescription labels providing prescription instructions as to the dosage schedule and amount; and the patient or caregiver inserting the duplicate prescription labels of prescriptions currently being taken by the patient into the pockets of the first storage system and removing duplicate prescription labels from the pockets of the first storage system for any prescriptions not currently being taken by the patient;

providing the patient or the caregiver with a second storage system with pockets for removably storing and visually displaying duplicate prescription labels corresponding to the prescription labels on the prescription containers of drugs not being actively taken by a patient; and the patient or the caregiver inserting duplicate prescription labels of the drugs not being taken by the patient;

providing the patient or the caregiver with distinctive stickers to indicate time divisions appropriate to the prescription instructions;

the patient or the caregiver translating the prescription instructions of each duplicate prescription label of drugs being actively taken in the pockets of the first storage system into the stickers, the selected stickers indicating the dosage schedule and by the number of said selected stickers indicating the amount;

the patient or the caregiver applying the selected stickers to each duplicate prescription label in the pockets of the first storage system and to each prescription container; and, the patient or the caregiver dispensing said medications to a patient in accordance with the stickers applied to the duplicate prescription labels in the pockets of the first storage system or to the prescription containers, providing the patient or the caregiver with a pill organizer with a plurality of compartments arranged in columns and rows;

the patient or the caregiver applying the stickers to indicate the time divisions appropriate to the prescription instructions to the rows; and, the patient or the caregiver dispensing said medications into the pill organizer in accordance with the stickers applied to the duplicate prescription labels or to the prescription containers.

8. The method of claim 7 wherein the stickers are distinguishable by geometric shape.

9. The method of claim 7 wherein the stickers are distinguishable by color.

10. The method of claim 7 wherein the stickers are distinguishable by geometric shape and color.

* * * * *